US007782159B2

(12) United States Patent
Beckley et al.

(10) Patent No.: US 7,782,159 B2
(45) Date of Patent: Aug. 24, 2010

(54) LARGE DIAMETER RF ROTARY COUPLER USED WITH A PASSIVE RF SENSOR

(75) Inventors: John Peter Beckley, Kidlington (GB); Victor Alexandrovich Kalinin, Headington (GB)

(73) Assignee: Transense Technologies, PLC (GB)

( * ) Notice: Subject to any disclaimer, the term of this patent is extended or adjusted under 35 U.S.C. 154(b) by 28 days.

(21) Appl. No.: 11/885,813

(22) PCT Filed: Feb. 8, 2006

(86) PCT No.: PCT/GB2006/000442

§ 371 (c)(1),
(2), (4) Date: Apr. 28, 2008

(87) PCT Pub. No.: WO2006/095125

PCT Pub. Date: Sep. 14, 2006

(65) Prior Publication Data

US 2008/0278267 A1 Nov. 13, 2008

(30) Foreign Application Priority Data

Mar. 9, 2005 (GB) ..... 0504846.7

(51) Int. Cl.
*H01P 1/06* (2006.01)

(52) U.S. Cl. ..... 333/261; 333/24 R

(58) Field of Classification Search ..... 333/261, 333/256, 24 R, 24 C, 111
See application file for complete search history.

(56) References Cited

U.S. PATENT DOCUMENTS 4,516,097 A * 5/1985 Munson et al. ..... 333/261
4,730,224 A 3/1988 Komatsu
5,192,923 A 3/1993 Komatsu
5,892,411 A * 4/1999 Schwan et al. ..... 333/24 R (Continued)

FOREIGN PATENT DOCUMENTS

GB 2 328 086 A 2/1999

(Continued)

*Primary Examiner*—Benny Lee
(74) *Attorney, Agent, or Firm*—Keusey & Associates, P.C.

(57) ABSTRACT

A rotary coupler comprises a stator 1 having a first face 3*a* and a rotor 2 having a second face 4*a*, the first and second faces 3*a*, 4*a* being spaced apart from and facing each other. A first electrically conducting track 5 is provided on the first face 3*a* of the stator 1 which forms a transmission line and has spaced apart ends A, B and a second electrically conducting track 6 is provided on the second surface 4*a* of the rotor 2 also forming a transmission line and having spaced apart ends C, D. One end A of the first track 5, in use, is connected to signal generating means and the other end B of the first track is connected to earth through a resistor substantially equal to the characteristic impedance of the transmission line. The first track 5 extends along a generally circular arc substantially around the first face 3*a* of the stator 1, the first track 5 having a length substantially equal to an integer number of wavelengths of the signal produced, in use, by the signal generating means. The second track (6) extends along a generally circular arc partially around the second face 4*a* of the rotor 2, the second track 6 having a length substantially equal to one quarter of the wavelength of the signal produced, in use, by the signal generating means.

17 Claims, 3 Drawing Sheets

U.S. PATENT DOCUMENTS

| | | | | |
|---|---|---|---|---|
| 2003/0174062 | A1 | 9/2003 | Lonsdale et al. | |
| 2008/0061910 | A1 * | 3/2008 | Kalinin et al. | 333/261 |

FOREIGN PATENT DOCUMENTS

| | | | |
|---|---|---|---|
| GB | 2 368 470 | A | 5/2002 |
| JP | 61106903 | | 5/1984 |
| WO | WO 96/37921 | | 11/1996 |

* cited by examiner

LARGE DIAMETER RF ROTARY COUPLER USED WITH A PASSIVE RF SENSOR

CROSS REFERENCE TO RELATED APPLICATIONS

This application claims the benefit of PCT Application No. PCT/GB2006/000442, filed on Feb. 8, 2006, and Great Britain Application No. 0504846.7, filed on Mar. 9, 2005.

FIELD OF THE INVENTION

The present invention relates to RF rotary couplers and in particular to couplers which electrically couple a passive RF sensor based on resonators or delay lines on a rotating shaft to stationary interrogation electronics in a wireless or mechanically non contacting manner.

BACKGROUND

WO96/37921 and GB 2 328 086 have described systems in which coupled microstrip lines arc used to connect to a sensor wirelessly. In particular, they use two circular coupled transmission lines of nominally equal circumference so that intrinsically the amount of coupling will always vary with rotation. These systems have the drawback, however, that they are not very effective for microstrips significantly larger than ¼λ, where λ is the wavelength of the transmitted signal.

Another system is described in GB 2 368 470 which allows for 360° coupling between microstrip lines for diameters above ¼λ. These systems work by connecting together multiple sections of ¼λ coupled microstrips together and spreading these lines around a larger diameter. These systems suffer from the fact that the larger the diameter the more ¼λ elements that are needed and the feeding networks can then become quite cumbersome. They also suffer from the same problem as the aforementioned systems in that the amount of coupling will intrinsically vary with rotation.

SUMMARY OF THE INVENTION

According to the present invention there is provided a rotary coupler comprising a stator having a first surface and a rotor having a second surface, the first and second surfaces being spaced apart from and facing each other, a first electrically conducting track provided on the first surface of the stator forming a transmission line and having spaced apart ends and a second electrically conducting track provided on the second surface of the rotor also forming a transmission line and having spaced apart ends, one end of the first track, in use, being connected to signal generating means and the other end of the first track being connected to earth through a resistor equal to the characteristic impedance of the transmission line, the first track extending along a generally circular arc substantially around the first face of the stator, the first track having a length substantially equal to an integer number of wavelengths of the signal produced, in use, by the signal generating means, and the second track extending along a generally circular arc partially around the second face of the rotor, the second track having a length which is smaller than the length of the second track.

Above and hereinafter, the term "generally circular arc" is used to cover both a path which extends along a smooth circular arc, having a length equal to the length of the arc, as well as a path which undulates but whose average path or average radius defines a substantially circular arc, whereby the actually length of the path is greater than the length of the average circular arc defined by the path.

A coupler in accordance with the invention has the advantage that there is no discontinuity in the field distribution in the stator transmission line and as a result there is no angular variation of the resonant frequency (or differential phase delay) of the sensor connected to the rotor output and measured at the stator input.

For optimum coupling, the length of the second track is substantially equal to one quarter of the wavelength of the signal produced, in use, by the signal generating means. The second track may, however, also be implemented with a length other than one quarter of the wavelength of the signal produced, in use, by the signal generating means depending upon the output impedance of the rotor.

Preferably, each of the rotor and the stator are formed of a substrate having a conducting back which forms a ground plane for the track disposed thereon. More particularly, one end of the track on the rotor is preferably connected to the ground plane, either directly or in directly. A sensor is then preferably connected between one end of the rotor track and earth, and the other end of the rotor track is then either shorted directly to ground, in which case for optimum coupling the second track should have a length substantially equal to one quarter of the wavelength of the signal produced, in use, by the signal generating means, or connected to a capacitor which is grounded, in which case the second track advantageously has a length which is less than one quarter of the wavelength of the signal produced by the signal generating means in order to achieve optimum coupling. Optionally, an inductor could be connected in parallel with the sensor connected to the one end of the rotor track.

Preferably, the rotor track extends along a substantially smooth circular arc which is concentric with the shaft on which, in use the rotor is mounted. In one embodiment, the stator track similarly extends along a substantially smooth circular arc, through slightly less than 360 degrees. In applications in which an integer number of wavelength is larger than the circumference of the arc, however, the stator track extends around the face in an undulating fashion, extending back and forth across a circular arc which defines the average path thereof. For example, the track might zig-zag around the face or travel in a more irregular fashion, in either event, the actual length of the track being longer than the length of the circular arc defining the average path.

In one embodiment, the rotor and stator are each formed by an annular disc mounted concentrically onto the shaft, the rotor and stator being axially separated from each other and the first and second faces being formed by facing axial annular faces of the stator and rotor.

Alternatively, the rotor and stator may each be formed as a cylindrical member, the rotor being concentrically positioned with the stator and having an outer diameter which is slightly smaller than the inner diameter of the stator so as to define a space therebetween. The first and second faces will then be formed by the inner cylindrical surface of the stator and the outer cylindrical surface of the rotor respectively, the tracks extending around the respective surface along a circular arc, or generally along a circular arc, centred on the centre of the shaft. Any undulation or meandering in the stator track will then be in the axial direction.

Preferably, the circular arc defining the path of the rotor and stator tracks have substantially the same radii, although in the case of the cylindrical rotor and stator, the radius of curvature of the stator track will necessarily be slightly larger than that of the rotor track.

Multiple rotor tracks may optionally be provided, isolated from each other. Multiple sensors may also optionally be connected to the, or each, rotor track, either in series or parallel.

The coupler is based upon two mechanically separate microstrips of differing lengths. The microstrip on the stator assembly is circular and has an electrical length which is nominally a wavelength (λ) long (or integer multiply there of). The rotor microstrip is an arc on nominally the same radius as the stator but with an electrical length of preferably approximately ¼λ or less. The stator microstrip should be terminated in a load that is similar to the characteristic impedance of the line. The rotor can be terminated with any suitable load. FIG. 1 shows an example of one configuration.

BRIEF DESCRIPTION OF THE DRAWINGS

In order that the invention may be well understood, there will now be described some embodiments thereof, given by way of example, reference being made to the accompanying drawings, in which.

DETAILED DESCRIPTION OF THE INVENTION

Figure 1:
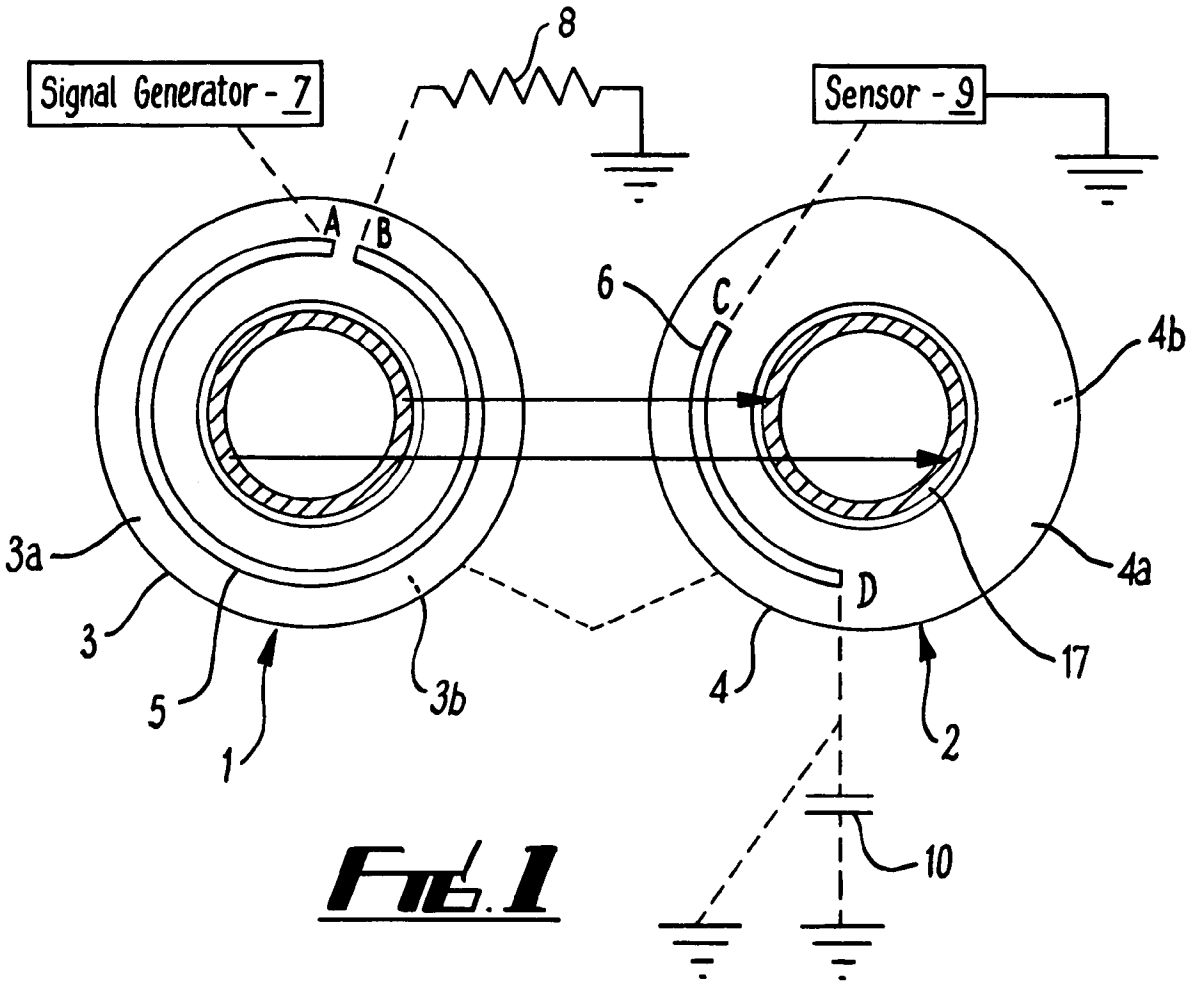
FIG. 1 is a schematic illustration of a rotary coupler according to a first embodiment of the invention.

Referring first to FIG. 1, there is shown two halves of a rotary coupler according to the invention comprising a stator 1 and a rotor 2. In the illustrated axial embodiment, the rotor 2 and stator 1 are formed by annular discs 3, 4 which, in use, would be positioned over a rotating shaft 17 with annular faces 3*a*, 4*a* directed towards each other and spaced apart from each other so that no direct mechanical contact is made therebetween. Preferably, each of the rotor 2 and the stator 1 are formed of a substrate having a conducting back 4*b* and 3*b*, respectively, which forms a ground plane for the track disposed thereon.

The two halves of the coupler shown in FIG. 1 would be positioned over a rotating shaft so that the two microstrips face each other but spaced apart so no direct mechanical contact is made. The signal is fed from Signal Generator 7 into the stator microstrip between terminal 'A' and the ground plane on the back of the substrate. Terminal 'B' is also to be connected to the ground plane via a resistor 8 approximately equal to the characteristic impedance of the line. On the rotor the sensor 9 is connected between terminal 'C' and the ground plane and terminal 'D' grounded through a capacitor 10 or shorted directly to the ground plane of the substrate. The design shown has the microstrips on two planar surfaces, they could however be coaxial to each other and the shaft.

The facing annular faces 3*a*, 4*a* of the stator and rotor discs 3, 4 each have an electrically conducting microstrip 5, 6 provided thereon which operate as antennas for respectively transmitting and receiving a signal. The microstrip 5 on the stator is defined by a substantially circular arc which is concentric with the stator disc 3, extends substantially around the face 3*a* of the stator disc 3 although with its ends A, B separated from each other and has an electrical length which is substantially equal to λ, the wavelength of the signal which is to be transmitted by the stator 3, thereby minimising the discontinuity in the field above the terminals 'A' and 'B'. If the track length is equal exactly 1λ, and the line is loss less then the instantaneous signal seen at terminal 'A' will equal that in phase and magnitude of the one seen at 'B'. The importance of this is so that the coupling to the rotor microstrip 6 will remain constant with rotation. The only property of the signal to change will be the phase as the effective path length of the signal changes with rotation.

The signal is fed from a circuit into the stator microstrip 5 between terminal 'A' and the ground plane formed by the substrate forming the body of the stator disc 3. Terminal 'B' is connected to the ground plane via a resistor the value of which is substantially equal to the characteristic impedance of the circuit feeding the signal to the stator microstrip 5.

The microstrip 6 on the rotor 4 is formed as a circular arc which extends only partially around the shaft on which, in use, the rotor 4 is mounted between terminals 'C' and 'D' and has a length equal to λ/4, one quarter of the wavelength of the signal fed to the stator 3. The main body of the rotor disc 4 again forms a ground plane for the microstrip 6 with a sensor 9 connected between the terminal 'C' and the ground plane for detecting the signal transmitted by from the stator 3, and the terminal 'D' being shorted directly to the ground plane. It will, or course, be understood that the end chosen to have a particular connection as described above is arbitrary and may be interchanged, i.e. terminal C may be shorted to ground and the sensor connected between terminal D and ground.

In the embodiment of FIG. 1, the radius of the arc of the rotor and stator microstrips 6, 5 are the same, although they do not need to be exactly so. Optionally, one could directly short terminal 'D' to ground, or a capacitor 10 could be connected between 'D' and the ground plane which would allow for tuning of the effective length of this line. In this case, the length of the microstrip 6 on the rotor 4 should be reduced to less than λ/4 for optimum coupling. Furthermore, an inductor could be placed in parallel to the sensor at terminal 'C' so as to allow the magnitude of the reflected signal from the sensor to be optimised.

In a further modification of the system of FIG. 1, multiple sensors could be provided on the rotor microstrip, connected to terminal 'C' either in series or in parallel. It would also be possible to provide multiple microstrips on the rotor 4, each of length λ/4, and each having a sensor electrically connected to its 'C' terminal, each the microstrip being interrogated through the same stator microstrip. In a still further modification, multiple microstrips could be provided on the stator 3 having different lengths and operable with signals of different wavelengths, each stator strip then being tuned to a corresponding rotor strip by appropriate fixing of the lengths thereof.

Preferably, the length of the stator strip 5 is slightly different to λ or the stator 3 load resistance slightly differs from characteristic impedance such that an amplitude variation with rotation arises. In this way, it is possible to measure the angle or speed of rotation.

Figure 2:
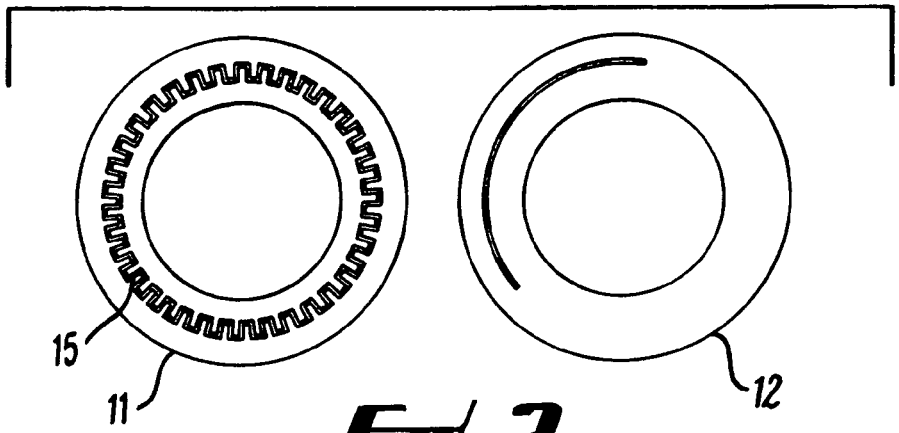
FIG. 2 is a schematic illustrating an embodiment of the present principles wherein the stator strip extends along a path which is generally circular but which undulates away from the average radius so as to increase the length of the track.

In the embodiment of FIG. 1, the fact that the stator microstrip 5 needs to be of length λ imposes a constraint on the mechanical design of the system as for a given dielectric, it fixes the diameter of the coupler. This drawback is overcome in an alternative embodiment illustrated in FIG. 2, showing a stator 11 and a rotor 12. The stator strip 15 is configured to extend along a path which is still generally circular but which undulates away from the average radius so as to increase the length of the track. This can be achieved, for example, by having the track zig-zag in the radial direction either side of the average radius, or by following an irregular undulating path. As clearly shown in FIG. 2, the rotor microstrip still follows a smooth circular arc equal to substantially λ/4 and having a radius substantially equal to the average radius of the generally circular path defined by the stator track. In this way, it is possible to package a stator track 15 having the same electrical length in a smaller average diameter.

Figure 4:
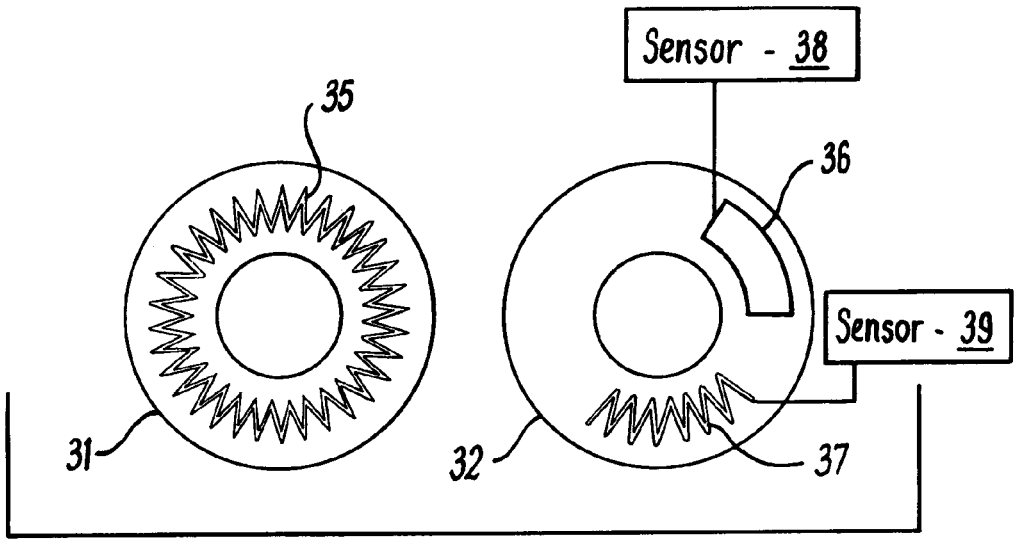
FIG. 4, is a schematic illustrating an embodiment of the present principles wherein the effective width of the rotor strip is substantially equal to the effective width of the stator strip provided on the stator.

In a further development of the embodiment of FIG. 2, illustrated in FIG. 4, the rotor strip 36 on the rotor 32 is modified to encompass a radial width which is substantially equal to the radial distance between the maximum and minimum radial positions of the undulating stator strip 35 provided on the stator 31—i.e. the effective width of the rotor strip 36 is substantially equal to the effective width of the stator strip 35 provided on the stator 31. The length of the rotor strip is then preferably less than or equal to λ/4. In this system, the rotor strip may be formed by an arcuate band of constant radial width as shown by rotor strip 36 in FIG. 4, or may advantageously be formed by an undulating track as with the rotor strip 37 in FIG. 4, whose effective radial width is substantially equal to the effective radial width of the stator track, the length of the average arcuate path then preferably being less than or equal to λ/4. Multiple sensors 38,39 may be connected to the multiple tracks 36, 37, respectively.

Figure 3:
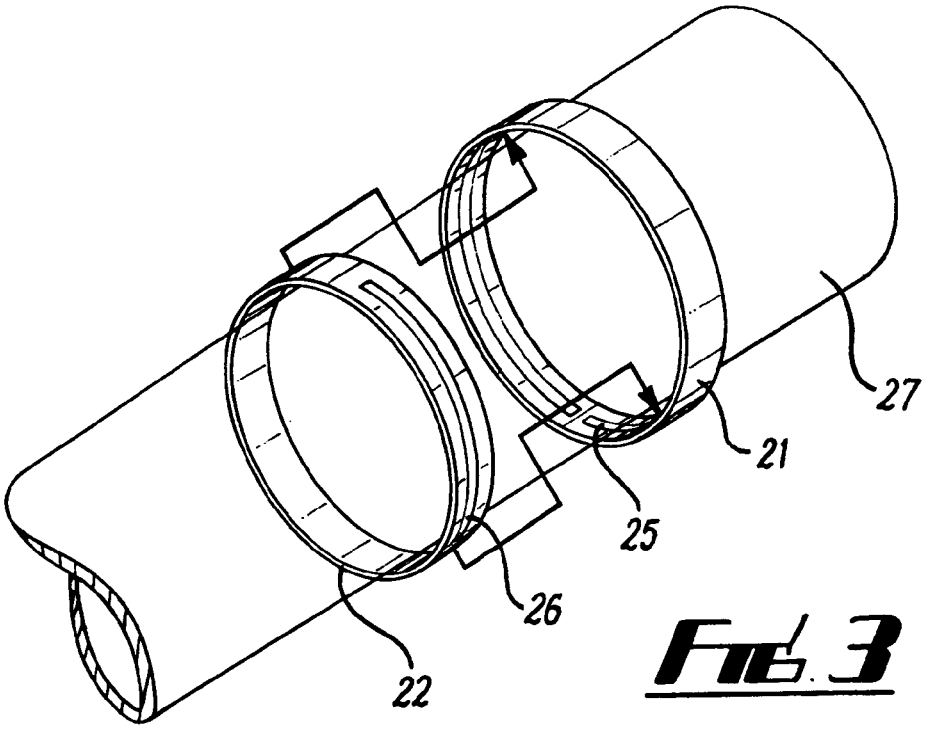
FIG. 3 is a schematic illustrating a further embodiment according to the present principles in which the rotor and stator are cylindrically shaped and concentrically arranged with the rotor inside the stator.

FIG. 3 illustrates a further embodiment in which the rotor 22 and stator 21 are cylindrically shaped and concentrically arranged on a shaft 27 with the rotor 22 inside the stator 21 so as to have co-operating inner and outer cylindrical surfaces facing each other and spaced apart so as not to be in contact. Microstrips 25,26 are then provided on the facing surfaces so as to extend circumferentially around the inner and outer cylindrical surfaces, the stator strip 25 having a length substantially equal to λ and the rotor strip 26 substantially equal to λ/4. The stator strip 25 extends along a general circular path with its ends spaced apart as in the previous embodiment, and may be configured in an undulating path, the undulations extending axially from the average path, in order to increase the electrical length without increasing the radius of the stator cylinder.

The invention claimed is:

1. A rotary coupler comprising:

a stator comprising a stator surface and a first electrically conducting track disposed on said stator surface for providing a single transmission line and having a first end and a second end spaced from the first end, said first track extending along a generally circular arc substantially around said stator surface; and a rotor comprising a rotor surface and a second electrically conducting track disposed on said rotor surface for providing a transmission line and having a first end and a second end spaced from the first end, said second track extending along a generally circular arc partially around said rotor surface, said second track having a length which is less than the length of the first track, wherein said rotor surface is spaced apart from and facing said stator surface;

a passive RF measuring sensor based on one of resonators or delay lines;

wherein the first end of said first track is configured to be connected to signal generating means and said second end of said first track is configured to be connected to ground through a resistor having a resistance substantially equal to the characteristic impedance of the transmission line provided by the first track;

wherein said first track has a length substantially equal to an integer number of wavelengths of a signal produced by said signal generating means; and wherein the first end of said second track is configured to be connected to ground through said passive RF measuring sensor.

2. A rotary coupler according to claim 1, wherein the second track comprises a base circular arc having a plurality of circumferentially spaced radial tracks extending therefrom.

3. A rotary coupler according to claim 2, wherein the radial width of the first track is substantially equal to the radial width of the second track.

4. A rotary coupler according to claim 1, wherein the stator and the rotor are respectively comprised of a pair of annular discs which are concentrically mounted on a shaft and are axially spaced apart from each other.

5. A rotary coupler according to claim 1, wherein the stator and rotor are each comprised of a cylindrical member, said first and second tracks being disposed on respective cylindrical surfaces of the stator and rotor.

6. A rotary coupler according to claim 5, wherein the rotor is positioned concentrically within and axially aligned with the stator, the rotor having an outer diameter which is slightly smaller than the inner diameter of the stator such that the first and second tracks are radially spaced apart.

7. A rotary coupler according to claim 6, wherein the first track is provided on the inner cylindrical surface of the stator and the second track is provided on the outer cylindrical surface of the rotor.

8. A rotary coupler according to claim 1, wherein the stator is mounted on a shaft and the first track extends along a substantially smooth circular arc concentric with the shaft.

9. A rotary coupler according to claim 1, wherein the rotor is mounted on a shaft and the second track extends along a substantially smooth circular arc concentric with the shaft.

10. A rotary coupler according to claim 1, wherein a plurality of tracks are provided on the second surface of the rotor, each of the tracks on the rotor being isolated from the other tracks on the rotor.

11. A rotary coupler according to claim 10, wherein multiple sensors are connected to each track provided on the rotor.

12. A rotary coupler according to claim 1, wherein the rotor is mounted on a shaft and the second track extends along a substantially smooth circular arc which is concentric with the shaft.

13. A rotary coupler according to claim 1, wherein length of the second track is less than or substantially equal to one quarter of the wavelength of the signal produced, in use, by said signal generating means.

14. A rotary coupler according to claim 1, wherein each of the stator and the rotor is comprised of a respective substrate having a conducting back which provides a grounding plane for the corresponding track disposed thereon.

15. A rotary coupler according to claim 1, wherein the second end of the second track is connected directly to ground, the second track preferably having a length substantially equal to one quarter of the wavelength of the signal produced, in use, by said signal generating means.

16. A rotary coupler according to claim 1, wherein the second end of the second track is connected to ground through a capacitor, the second track preferably having a length substantially equal to one quarter of the wavelength of the signal produced, in use, by said signal generating means.

17. A rotary coupler according to claim 1, wherein the first track extends along a circular arc which is just less than 360 degrees.

* * * * *